US006610943B1

(12) United States Patent
Durfee et al.

(10) Patent No.: US 6,610,943 B1
(45) Date of Patent: Aug. 26, 2003

(54) MEMBRANE SWITCH VENTING ARRANGEMENT FOR WASHING APPLIANCE

(76) Inventors: Anthony Lewis Durfee, 49 Southwood Dr., Jackson, TN (US) 38301; Thomas M. Johnson, 5 Deepwood Dr., Jackson, TN (US) 38305; John Henry Miilu, 21 Bent Willow Cove, Jackson, TN (US) 38305

( * ) Notice: Subject to any disclaimer, the term of this patent is extended or adjusted under 35 U.S.C. 154(b) by 74 days.

(21) Appl. No.: 10/186,949

(22) Filed: Jul. 2, 2002

(51) Int. Cl.[7] ..... H05H 13/70
(52) U.S. Cl. ..... 200/302.1; 200/515
(58) Field of Search ..... 200/512, 515, 200/293–296, 302.1, 302.2, 306

(56) References Cited

U.S. PATENT DOCUMENTS

| | | | | | |
|---|---|---|---|---|---|
| 4,018,999 A | | 4/1977 | Robinson et al. | ..... | 200/5 A |
| 4,467,151 A | | 8/1984 | Johnson et al. | ..... | 200/5 A |
| 4,485,279 A | * | 11/1984 | Nakamura | ..... | 200/5 A |
| 4,596,905 A | | 6/1986 | Fowler | ..... | 200/5 A |
| 5,218,177 A | | 6/1993 | Coleman, III et al. | ..... | 200/5 A |
| 5,453,586 A | * | 9/1995 | Stottmann | ..... | 200/5 R |
| 5,475,192 A | | 12/1995 | Inagaki et al. | ..... | 200/341 |
| 5,613,599 A | | 3/1997 | Inagaki et al. | ..... | 200/512 |
| 5,747,757 A | * | 5/1998 | Van Zeeland et al. | ..... | 200/5 A |
| 5,874,700 A | * | 2/1999 | Hochgesang | ..... | 200/515 |
| 6,137,072 A | * | 10/2000 | Martter et al. | ..... | 200/512 |
| 6,441,330 B2 | * | 8/2002 | Liao | ..... | 200/515 |

* cited by examiner

*Primary Examiner*—Michael Friedhofer
(74) *Attorney, Agent, or Firm*—Diederiks & Whitelaw, PLC

(57) ABSTRACT

A membrane switch incorporated in a control panel of a domestic washing appliance is vented through a labyrinth venting arrangement composed of a long, small diameter, twisting passage, including concentric arcuate sections and an intermediate portion. The venting arrangement establishes an effective barrier to fluids and other moisture, while accommodating the free passage of gases. In the most preferred form, the labyrinth venting arrangement is formed by cutting a channel into a supporting plastic assembly and then adhesive bonding a control plate incorporating the membrane switch over the labyrinth feature to complete the passage. One end of the passage is open to atmosphere by way of a slot in the supporting plastic assembly, while the other end joins the venting path with the membrane switch.

18 Claims, 5 Drawing Sheets

MEMBRANE SWITCH VENTING ARRANGEMENT FOR WASHING APPLIANCE

BACKGROUND OF THE INVENTION

1. Field of the Invention

The present invention pertains to the art of appliances and, more particularly, to a venting arrangement for a membrane switch employed in a domestic washing appliance.

2. Discussion of the Prior Art

When utilizing a switch, particularly a switch including a pair of closely spaced electrical contacts, a foreign material can undesirably become interposed between the contacts to inadvertently complete a circuit incorporating the contacts. In addition, or in the alternative, the foreign material may be corrosive.

Membrane-type switches can be particularly problematic in this regard. That is, based on the specific construction of the membrane switch, it may be necessary to vent the switch contacts to atmosphere. In general, this venting can be necessary to facilitate the operation of the switch over broad atmospheric and temperature extremes. Developed problems in this field can be exasperated when the environment surrounding the membrane switch is hostile to the switch due to the presence of excessive humidity, liquid, and the like. In extreme environments, switch contacts and circuitry are typically sealed to protect against damage.

Based on the above, there exists a need for an improved venting arrangement for a membrane switch which will enable the switch to be effectively used in the moisture-laden environment of certain domestic appliances, particularly dishwashers and clothes washing machines. That is, there exists a need to configure a venting arrangement for a membrane switch incorporated into a domestic appliance so as to prevent undesirable contamination of internal components of the switch.

SUMMARY OF THE INVENTION

The present invention is directed to the venting of a membrane switch incorporated in a domestic washing appliance in a manner which assures that the membrane switch can be effectively used in a moisture-laden environment. In accordance with the invention, the venting for the membrane switch includes an elaborate venting passage composed of a long, small diameter, twisting channel that provides a cost efficient and effective barrier to fluids and other moisture, while accommodating the free passage of gases. In the most preferred form, a labyrinth venting arrangement is formed by cutting a channel into a supporting plastic assembly and then adhesive bonding the switch over the labyrinth feature to complete the passage. One end of the passage is open to atmosphere by way of a slot in the supporting plastic assembly, while the other end joins the venting path with the membrane switch.

By employing the labyrinth venting arrangement, a membrane switch can be effectively incorporated in domestic appliances which, due to their functions, are inherently subjected to high humidity conditions. In any case, additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
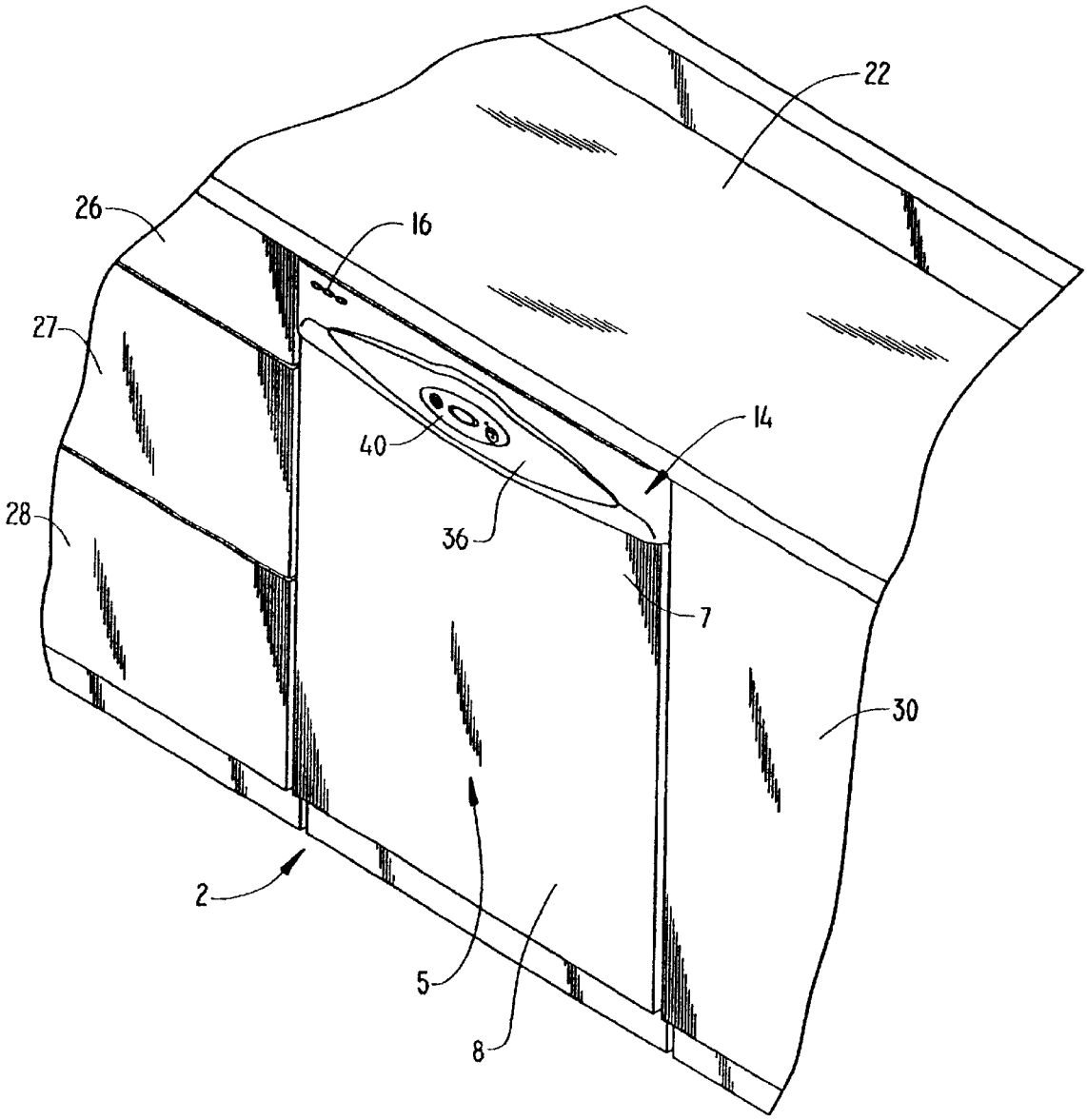
FIG. 1 is a perspective view of a dishwasher incorporating the labyrinth venting arrangement of the invention.

With initial reference to FIGS. 1 and 2, the present invention will be described in detail with reference to a dishwasher which is generally indicated at 2. As shown, dishwasher 2 includes a door 5 having an upper portion 7 and a lower portion 8. Provided at upper portion 7 is a control panel 14 having various control elements as will be detailed more fully below. Also provided at upper portion 7 is a plurality of vent openings 16. In a manner known in the art, door 5 is pivotally mounted at lower portion 8 for movement relative to and for closing off a washing tub 18. In addition, dishwasher 2 is shown positioned below a countertop 22 within a domestic kitchen. As such, shown on one side of dishwasher 2 is a plurality of vertically spaced drawers 26–28 and, on the other side of dishwasher 2, a cabinet 30.

Figure 2:
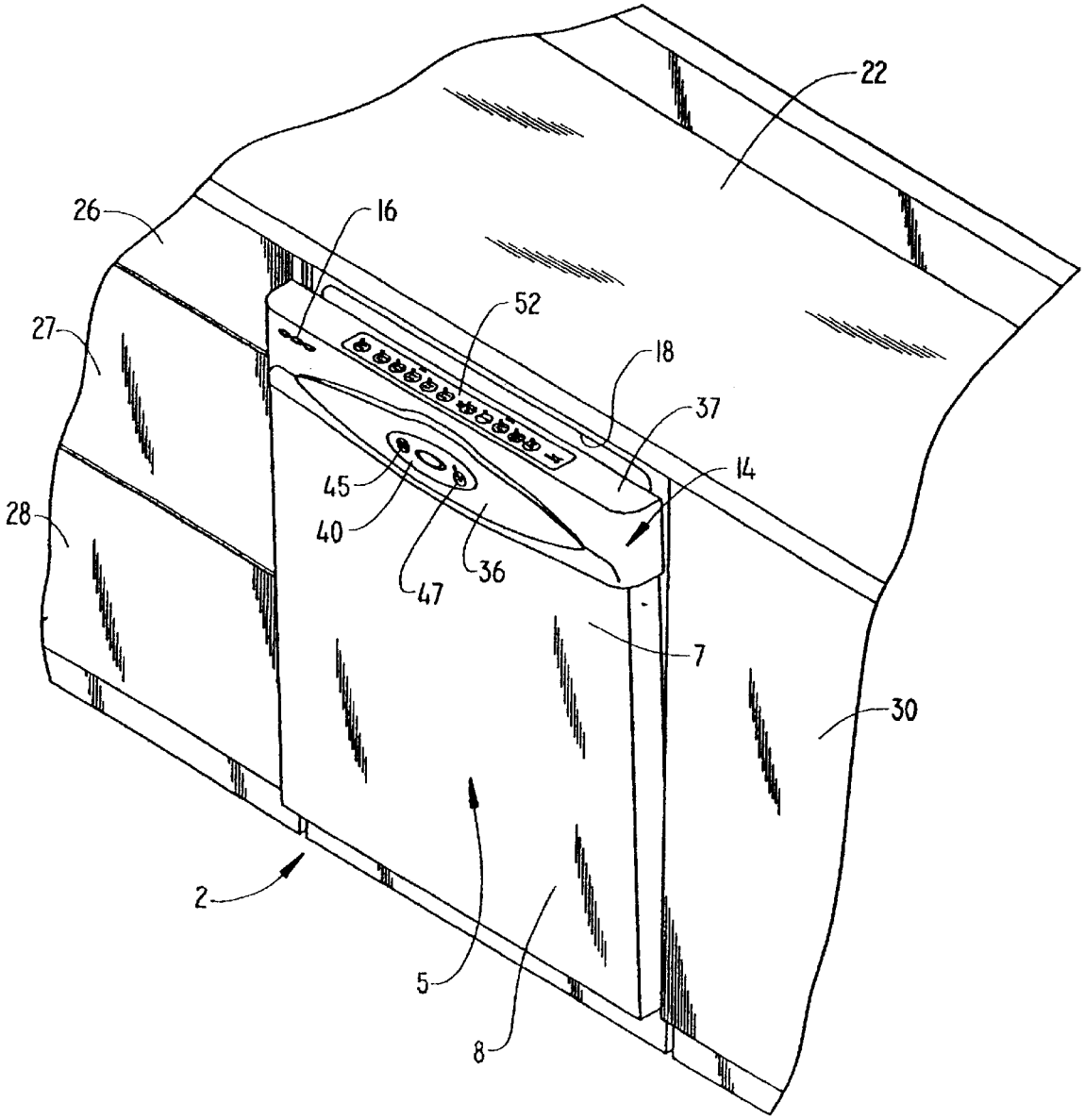
FIG. 2 is a perspective view of the dishwasher of FIG. 1, with a door of the dishwasher being slightly opened to expose control elements thereof.
Figure 3:
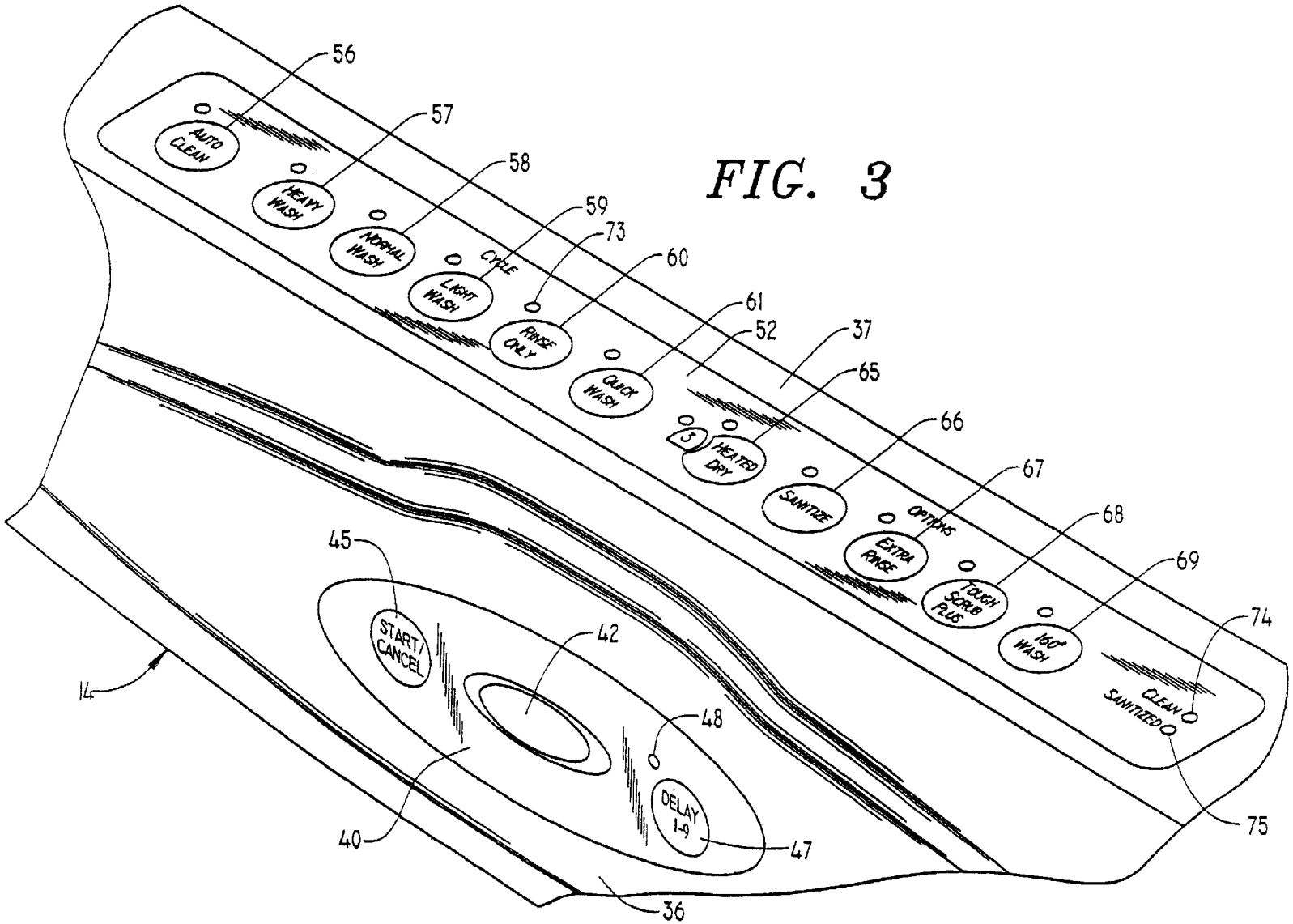
FIG. 3 is an enlarged, perspective view of the overall control arrangement of the invention.

Reference will now be made to FIGS. 2 and 3 in describing in further detail the various control elements employed on control panel 14 in accordance with a preferred embodiment of the invention. As illustrated, control panel 14 includes a front panel portion 36 and an upper panel portion 37. Within the confines of front panel portion 36 is defined a control section 40 including a display 42, a start/stop button 45 and a delay programming button 47. As depicted, an LED indicator 48 is provided to indicate when a delay cleaning operation is selected.

Control panel 14 also includes a control section 52 provided on upper panel portion 37. In the embodiment shown, control section 52 includes an auto clean, heavy wash, normal wash, light wash, rinse only and quick wash cycle selection buttons 56–61. Additional options are preferably provided, with these options being available through one or more of heated dry, sanitize, extra rinse, tough scrub plus and 160° F. wash buttons 65–69. Each of cycle and option buttons 56–61 and 65–69 is shown to have an associated LED indicator 73. In addition, separate clean and sanitized LED indicators 74 and 75 are also provided. At this point, it should be recognized that the overall configuration of control panel 14 as described above is exemplary in nature and that the available cycles, options and layout of the controls can be readily varied without departing from the invention.

Figure 4:
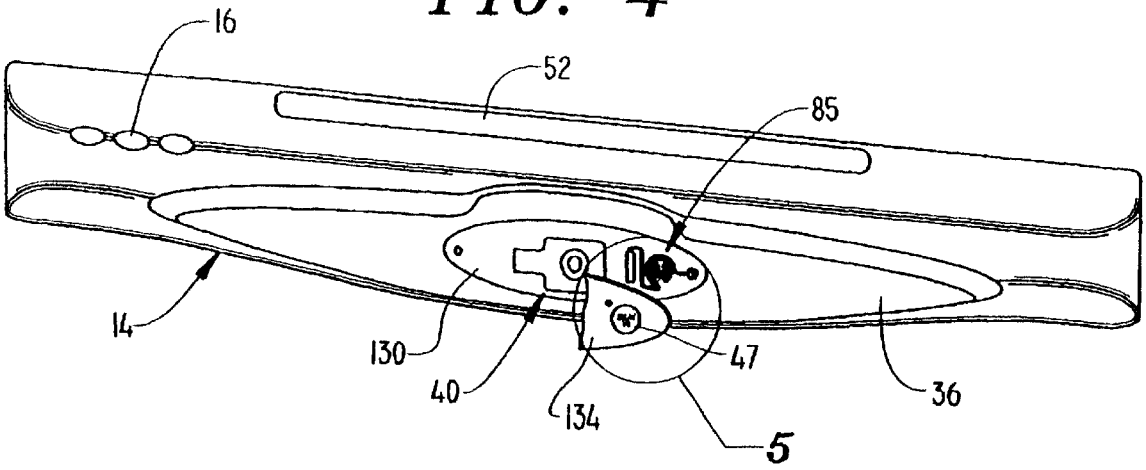
FIG. 4 is a frontal view of a control portion of the dishwasher, with an outer membrane layer thereof shown partially exploded to expose the labyrinth venting arrangement constructed in accordance with the invention.

In accordance with the present invention, each of buttons 56–61 and 65–69 are preferably constituted by membrane switches. Of course, membrane switches are generally known in the art of switches. However, the use of such switches can be particularly problematic in high moisture environments, particularly given the air pockets inherently associated therewith. Therefore, in accordance with the present invention, a labyrinth vent arrangement 85 (see FIGS. 4 and 5) is employed to allow the free passage of gases, while establishing an effective barrier to fluids and other moisture, for the membrane switches. In general, labyrinth vent passage 85 constitutes a long, small diameter, twisting passage as will now be described in detail.

Figure 5:
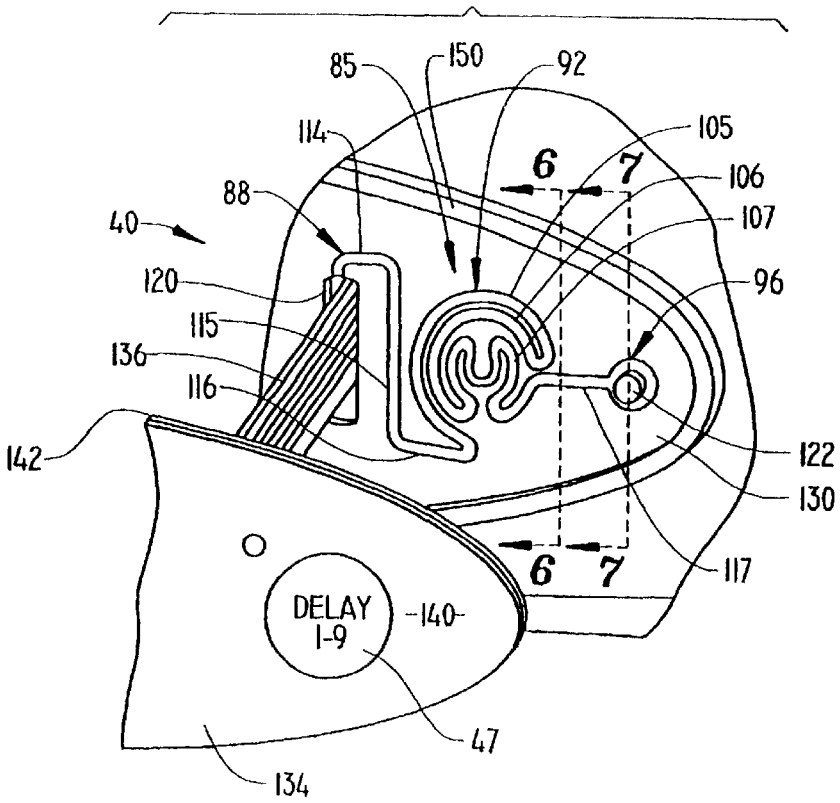
FIG. 5 is an enlarged, exploded view of the control portion to further illustrate the labyrinth venting arrangement of FIG. 4.

As best shown in FIG. 5, labyrinth vent passage 85 includes a first end portion 88, an intermediate portion 92 and a second end portion 96. In accordance with the most preferred form of the invention, intermediate portion 92 includes a plurality of concentric ring portions 105–107, each of which is made up of various arcuate segments (not separately labeled). As depicted, ring portions 105–107 preferably change direction numerous times, generally at the end of one ring and the beginning of the next. Between each of first end portion 88 and intermediate portion 92 is a plurality of sequential linear sections 114–116. Furthermore, a linear section 117 is interposed between intermediate portion 92 and second end portion 96. First end portion 88 of labyrinth vent arrangement 85 leads to a slot 120 which is open to atmosphere, while second end portion 96 preferably defines an annular terminal end section 121 that extends about an upstanding post 122.

Figure 6:
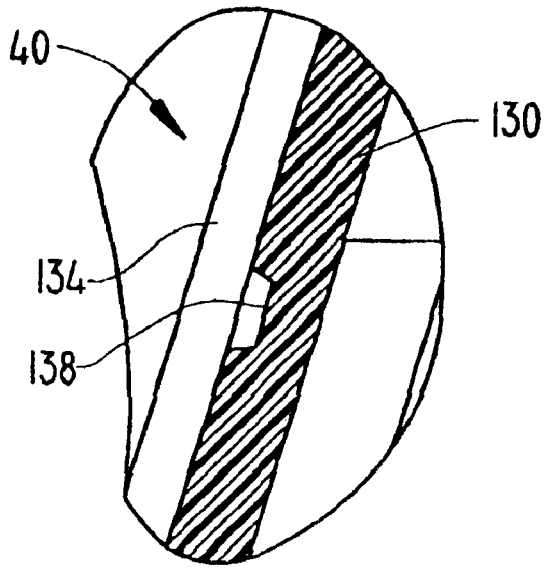
FIG. 6 is a cross-sectional view generally taken along line 6—6 in FIG. 5, but with the control portion assembled.
Figure 7:
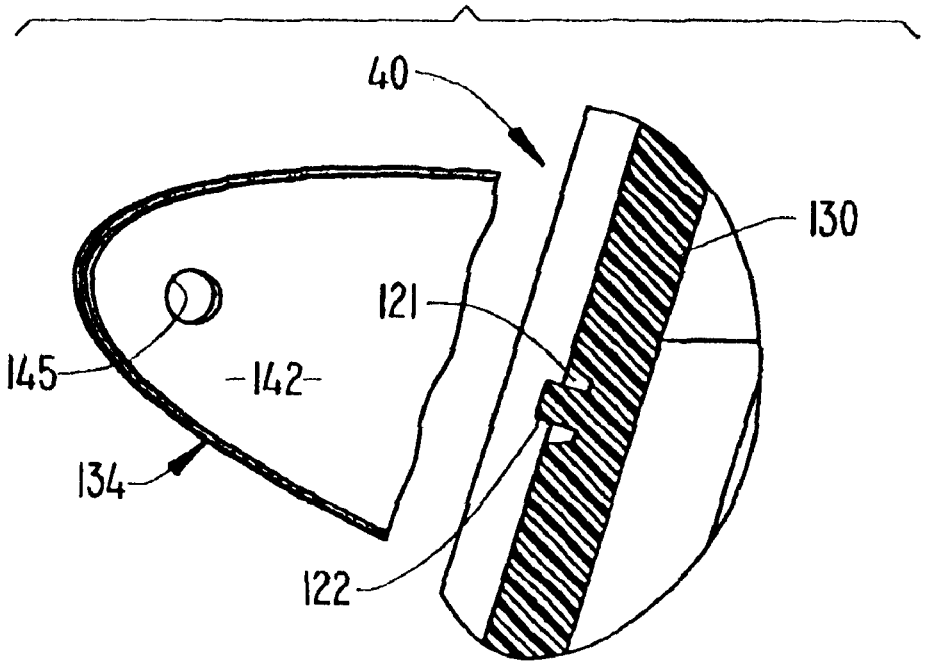
FIG. 7 is a cross-sectional view generally taken along line 7—7 in FIG. 5.

Reference will now be made to FIGS. 5–7 in describing the preferred manner of forming labyrinth vent passage 85. As shown, control section 40 of control panel 14 includes a support base 130 and a control plate 134. Control plate 134 houses various membrane switches corresponding to buttons 45 and 47 as described above. A flexible circuit board or sheet 136, which extends from and is sealed to control plate 134, electrically interconnects buttons 45 and 47, as well as display 42, to a controller (not shown) of dishwasher 2. In the most preferred form of the invention, base 130 and control plate 134 are both formed of plastic. A channel or groove 138 (see FIG. 6) is cut into support base 134 in a manner which defines first end portion 88, intermediate portion 92 and second end portion 96 of vent passage 85. An end of flexible circuit board 136 is then inserted through slot 120. Next, control plate 134 is positioned upon and secured to support base 130, such as by adhesive bonding, to cover channel 138 and to establish the labyrinth vent passage 85 which is then only open at first and second end portions 88 and 96.

Control plate 134 actually includes an outer or front layer 140 and an inner or rear layer 142 having slot 120. An opening or hole 145 (see FIG. 7) extends through inner layer 142, but not outer layer 140, and is exposed to the membrane switch(es) in control plate 134. Hole 145 has a diameter which is smaller than a diameter of post 122. When control plate 134 is laid over support base 130, post 122 projects into hole 145, thereby aiding in locating control plate 134 relative to support base 130, while hole 145 opens into annular terminal end section 100 of labyrinth vent passage 85. In addition, control plate 134 is preferably seated within an upstanding peripheral rim 150 provided as part of control section 40.

With this construction, labyrinth vent passage 85 is formed in a precise and economical manner, and enables the membrane switch(es) in control plate 134 to be effectively vented to atmosphere. Again, labyrinth vent passage 85 is sized and shaped to establish a mechanical barrier to fluids and moisture, while allowing the free passage of gases. Although described with reference to a preferred embodiment of the invention, it should be readily understood that various changes and/or modifications can be made to the invention without departing from the spirit thereof. For instance, although the invention has been described in detail with reference to dishwasher 2, it should be realized that the invention can also be employed in other appliances, specifically domestic washing appliances, particularly clothes washers, which will be inherently exposed to liquids and other forms of moisture during operation. In general, the invention is only intended to be limited by the scope of the following claims.

We claim:

1. A domestic appliance comprising:

a wash tub;

a door for closing off a portion of the wash tub;

a control panel including a plurality of control elements, with at least one of the control elements incorporating a membrane switch; and a labyrinth vent defined by a passage having a first end portion exposed to the membrane switch and a second end portion exposed to atmosphere, wherein the labyrinth vent is sized to create an effective barrier to fluids and other moisture, while accommodating a free flow of gases.

2. The domestic appliance according to claim 1, wherein the passage of the labyrinth vent includes an intermediate portion between the first and second end portions, said intermediate portion including a plurality of arcuate segments.

3. The domestic appliance according to claim 2, wherein the plurality of arcuate segments are substantially, concentrically arranged.

4. The domestic appliance according to claim 3, wherein the plurality of arcuate segments establish at least three concentric ring portions.

5. The domestic appliance according to claim 2, wherein the passage includes first and second linear sections, with the first linear section being interposed between the first end portion and the intermediate portion, and the second linear section being interposed between the second end portion and the intermediate portion.

6. The domestic appliance according to claim 1, wherein the control panel includes a support base, said passage being defined by a channel formed in the support base.

7. The domestic appliance according to claim 6, wherein the passage is open to atmosphere through the support base at the second end portion.

8. The domestic appliance according to claim 1, wherein the first end portion includes an annular terminal end.

9. The domestic appliance according to claim 8, further comprising: a post projecting from within the annular terminal end.

10. The domestic appliance according to claim 9, wherein the control panel includes a control plate including an outer layer and an inner layer, said control panel being provided with a hole extending through the inner layer, said post projecting into the hole.

11. The domestic appliance according to claim 1, wherein the domestic appliance constitutes a dishwasher.

12. In a domestic appliance including a wash tub and a control panel incorporating a membrane switch, a method of venting the membrane switch comprising:

creating the control panel with a labyrinth vent defined by an internal passage having a first end portion arranged at the membrane switch and a second end portion exposed to atmosphere; and accommodating, by means of the labyrinth vent, a free flow of gases between the membrane switch and atmosphere through the internal passage while establishing an effective barrier to fluids and other moisture.

13. The method of claim 12, further comprising: directing gases through various arcuate sections of the passage between the first and second end portions.

14. The method of claim 13, wherein the gases are directed through a plurality of substantially, concentrically arranged ring portions of the passage within the arcuate sections.

15. The method of claim 12, wherein creating the control panel with the labyrinth vent includes forming a channel in a support base of the control panel.

16. The method of claim 15, further comprising: securing a control plate of the control panel to the support base to seal the channel, except at the first and second end portions.

17. The method of claim 16, further comprising: positioning a post projecting from the support base into a hole formed in the control plate.

18. The method of claim 17, further comprising: exposing the membrane switch to the channel through the hole.

* * * * *